US011804179B2

(12) United States Patent
Kim et al.

(10) Patent No.: US 11,804,179 B2
(45) Date of Patent: Oct. 31, 2023

(54) ELECTROLUMINESCENT DISPLAY DEVICE

(71) Applicant: LG Display Co., Ltd., Seoul (KR)

(72) Inventors: Min Kim, Bucheon-si (KR); Hyuck Jun Kim, Paju-si (KR); Ji Su Choi, Seoul (KR); Tae Young Lee, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/538,477

(22) Filed: Nov. 30, 2021

(65) Prior Publication Data

US 2022/0208095 A1 Jun. 30, 2022

(30) Foreign Application Priority Data

Dec. 28, 2020 (KR) ..... 10-2020-0184551

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2300/0426* (2013.01); *G09G 2300/0842* (2013.01); *G09G 2310/08* (2013.01); *G09G 2320/0233* (2013.01); *G09G 2320/0295* (2013.01)

(58) Field of Classification Search
CPC ..... G09G 3/3233; G09G 3/3275; G09G 2300/0426; G09G 2300/0842; G09G 2310/08; G09G 2320/0233; G09G 2320/0295
See application file for complete search history.

(56) References Cited

U.S. PATENT DOCUMENTS

| | | | |
|---|---|---|---|
| 8,274,503 | B2 | 9/2012 | Kwon |
| 11,114,028 | B2 | 9/2021 | Yoon et al. |
| 11,217,171 | B2 | 1/2022 | Kim et al. |
| 2009/0027377 | A1 | 1/2009 | Kwon |

(Continued)

FOREIGN PATENT DOCUMENTS

| | | | |
|---|---|---|---|
| CN | 109308879 | A | 2/2019 |
| CN | 111326113 | A | 6/2020 |

(Continued)

OTHER PUBLICATIONS

Extended European Search Report, European Patent Office Application No. 21213201.3, dated Apr. 26, 2022, 12 pages.

(Continued)

*Primary Examiner* — Amare Mengistu
*Assistant Examiner* — Gloryvid Figueroa-Gibson
(74) *Attorney, Agent, or Firm* — Fenwick & West LLP

(57) ABSTRACT

An electroluminescent display device according to an embodiment of the present disclosure includes a pixel including a driving element having a gate electrode connected to a data line and a source electrode connected to a readout line, a sensing circuit configured to sense a voltage of the readout line which changes according to a pixel current flowing through the driving element during sensing operation, and a boosting circuit connected between the data line and the readout line and configured to change a voltage of the data line according to the changed voltage in the readout line during the sensing operation.

20 Claims, 15 Drawing Sheets

(56) References Cited

U.S. PATENT DOCUMENTS

| | | | | |
|---|---|---|---|---|
| 2018/0061314 | A1 | 3/2018 | Kim | |
| 2018/0061913 | A1* | 3/2018 | Kim | G09G 3/3225 |
| 2018/0190192 | A1* | 7/2018 | Kwon | G09G 3/3233 |
| 2019/0035335 | A1 | 1/2019 | Kim et al. | |
| 2020/0074930 | A1 | 3/2020 | Lee | |
| 2020/0143753 | A1 | 5/2020 | Park | |
| 2020/0152125 | A1 | 5/2020 | Ye et al. | |
| 2020/0160789 | A1* | 5/2020 | Park | G09G 3/3258 |
| 2020/0193905 | A1 | 6/2020 | Yoon et al. | |

FOREIGN PATENT DOCUMENTS

| | | | |
|---|---|---|---|
| EP | 2884484 | A1 | 6/2015 |
| EP | 3125226 | A1 | 2/2017 |
| JP | 2009-031712 | A | 2/2009 |
| KR | 10-2017-0021406 | A | 2/2017 |
| KR | 10-2020-0016042 | A | 2/2020 |

OTHER PUBLICATIONS

Intellectual Property India, Office Action, IN Patent Application No. 202114056425, dated Jul. 14, 2022, six pages.

Taiwan Intellectual Property Office, Office Action, TW Patent Application No. 110148935, dated Dec. 7, 2022, 14 pages.

Japan Patent Office, Office Action, JP Patent Application No. 2021-199701, dated Nov. 10, 2022, eight pages.

* cited by examiner

ELECTROLUMINESCENT DISPLAY DEVICE

This application claims the benefit of Korean Patent Application No. 10-2020-0184551, filed on Dec. 28, 2020, which is hereby incorporated by reference as if fully set forth herein.

BACKGROUND OF THE INVENTION

Field of the Invention

The present disclosure relates to an electroluminescent display device.

Discussion of the Related Art

Electroluminescent display devices are divided into an inorganic light emitting display device and an organic light emitting display device according to a material of an emission layer. Each pixel of an electroluminescent display device includes a self-emissive light emitting element and adjusts luminance by controlling the amount of emission of the light emitting element according to a data voltage depending on grayscales of video data.

Driving characteristic differences between pixels may be generated as driving time passes. Such driving characteristic differences cause luminance nonuniformity, deteriorating picture quality. Although various attempts to compensate for driving characteristic differences between pixels in an electroluminescent display device are made, there is a limit in securing luminance uniformity due to low sensing accuracy.

SUMMARY OF THE INVENTION

Accordingly, the present disclosure is directed to an electroluminescent display device that substantially obviates one or more problems due to limitations and disadvantages of the related art.

An object of the present disclosure is to provide an electroluminescent display device for improving sensing accuracy.

To achieve these objects and other advantages and in accordance with the purpose of the invention, as embodied and broadly described herein, an electroluminescent display device includes a pixel including a driving element having a gate electrode connected to a data line and a source electrode connected to a readout line, a sensing circuit configured to sense a voltage of the readout line which changes according to a pixel current flowing through the driving element during sensing operation, and a boosting circuit connected between the data line and the readout line and configured to change a voltage of the data line by voltage variation in the readout line during the sensing operation.

In another embodiment, an electroluminescent display device comprises a pixel including a driving element having a gate electrode connected to a data line and a source electrode connected to a readout line, a sensing circuit configured to sense a voltage of the readout line which changes according to a pixel current flowing through the driving element during sensing operation, and a boosting capacitor electrically coupled between the data line and the readout line, the boosting capacitor configured to couple the changed voltage of the readout line to the data line during the sensing operation.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
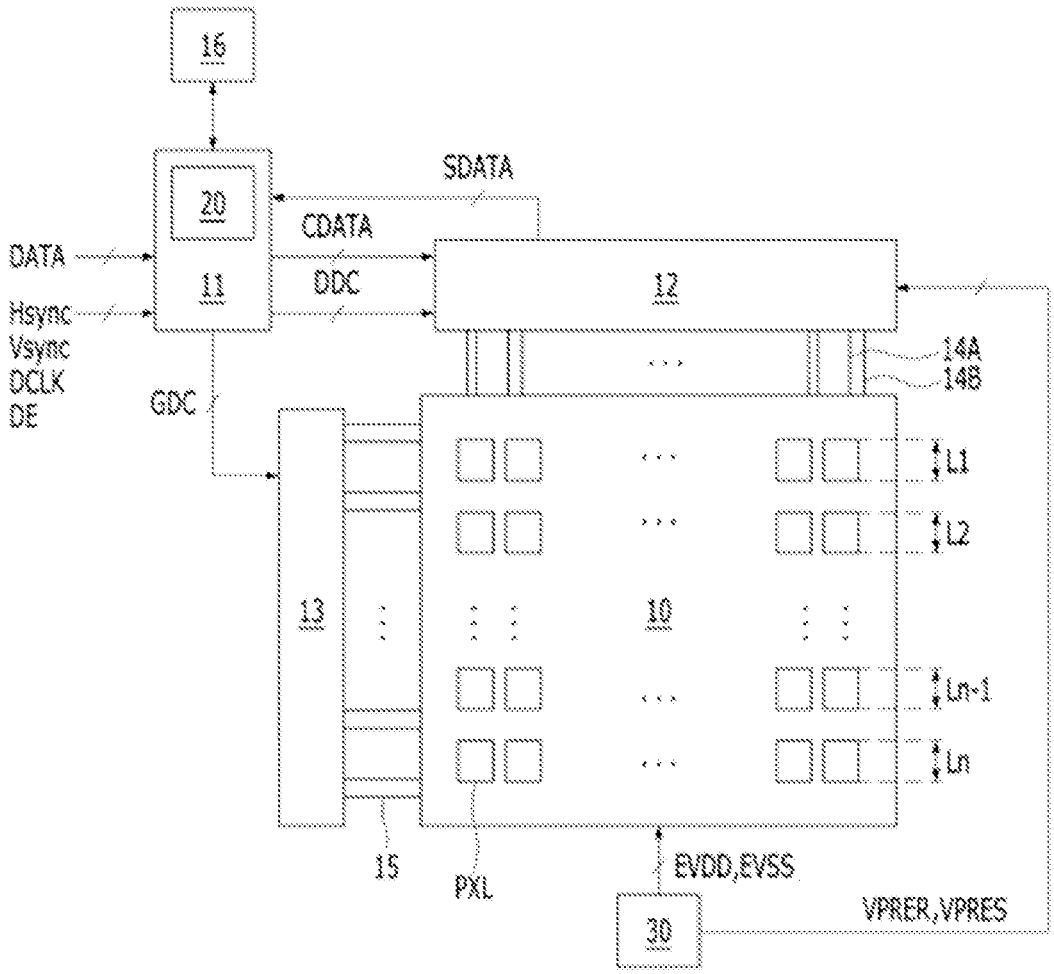
FIG. 1 is a block diagram showing an electroluminescent display device according to an embodiment of the present disclosure.

The advantages and features of the present disclosure and the way of attaining the same will become apparent with reference to embodiments described below in detail in conjunction with the accompanying drawings. The present disclosure, however, is not limited to the embodiments disclosed hereinafter and may be embodied in many different forms. Rather, these exemplary embodiments are provided so that this disclosure will be through and complete and will fully convey the scope to those skilled in the art. Thus, the scope of the present disclosure should be defined by the claims.

The shapes, sizes, ratios, angles, numbers, and the like, which are illustrated in the drawings in order to describe various embodiments of the present disclosure, are merely given by way of example, and therefore, the present disclosure is not limited to the illustrations in the drawings. The same or extremely similar elements are designated by the same reference numerals throughout the specification. In addition, in the description of the present disclosure, a detailed description of related known technologies will be omitted when it may make the subject matter of the present disclosure rather unclear. In the present specification, when the terms "comprise", "include", and the like are used, other elements may be added unless the term "only" is used. An element described in the singular form is intended to include a plurality of elements unless the context clearly indicates otherwise.

In the interpretation of constituent elements included in the various embodiments of the present disclosure, the constituent elements are interpreted as including an error range even if there is no explicit description thereof.

In the description of the various embodiments of the present disclosure, when describing positional relationships, for example, when the positional relationship between two parts is described using "on", "above", "below", "beside", or the like, one or more other parts may be located between the two parts unless the term "directly" or "closely" is used.

Although terms such as, for example, "first" and "second" may be used to describe various elements, these terms are merely used to distinguish the same or similar elements from each other. Therefore, in the present specification, an element modified by "first" may be the same as an element modified by "second" within the technical scope of the present disclosure unless otherwise mentioned.

In the present disclosure, a pixel circuit formed on a substrate of a display panel may be implemented as a thin film transistor (TFT) in an n-type metal oxide semiconductor field effect transistor (MOSFET) structure or a TFT in a p-type MOSFET structure. A TFT is a 3-electrode element including a gate, a source, and a drain. The source is an electrode that supplies carriers to the transistor. Carriers flow from the source in the TFT. The drain is an electrode through which carriers are discharged to the outside. That is, carriers flow from the source to the drain in a MOSFET. In the case of an n-type TFT (NMOS), carriers are electrons and thus a source voltage is lower than a drain voltage such that electrons can flow from the source to the drain. Since electrons flow from the source to the drain in the n-type TFT, current flows from the drain to the source. On the contrary, in the case of a p-type TFT (PMOS), carriers are holes and thus a source voltage is higher than a drain voltage such that holes can flow from the source to the drain. Since holes flow from the source to the drain in the p-type TFT, current flows from the source to the drain. It should be noted that the source and the drain of a MOSFET are not fixed. For example, the source and the drain of a MOSFET may be changed according to an applied voltage.

In the present disclosure, a semiconductor layer of a TFT may be formed of at least one of oxide, amorphous silicon, and polysilicon.

Hereinafter, embodiments of the present disclosure will be described in detail with reference to the attached drawings. In the following description, a detailed description of known functions and configurations incorporated herein will be omitted when it may obscure the subject matter of the present invention.

Figure 2:
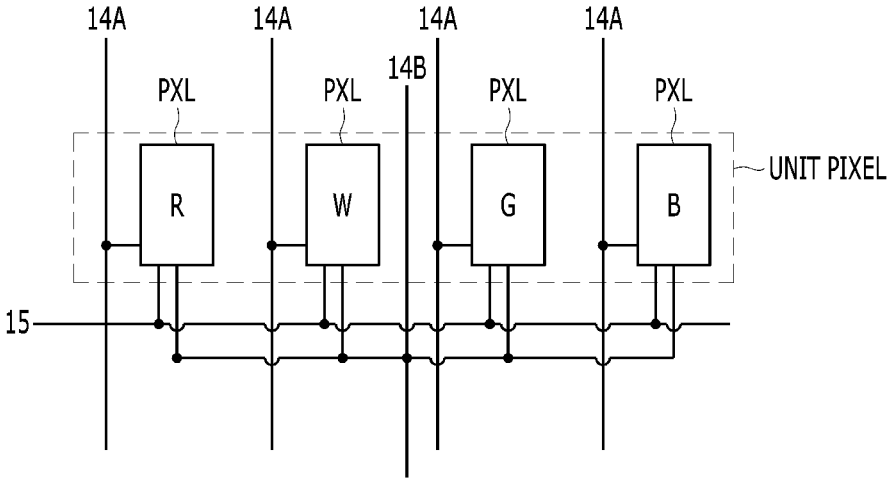
FIG. 2 is a diagram showing an example of connection of one unit pixel sharing a readout line.
Figure 3:
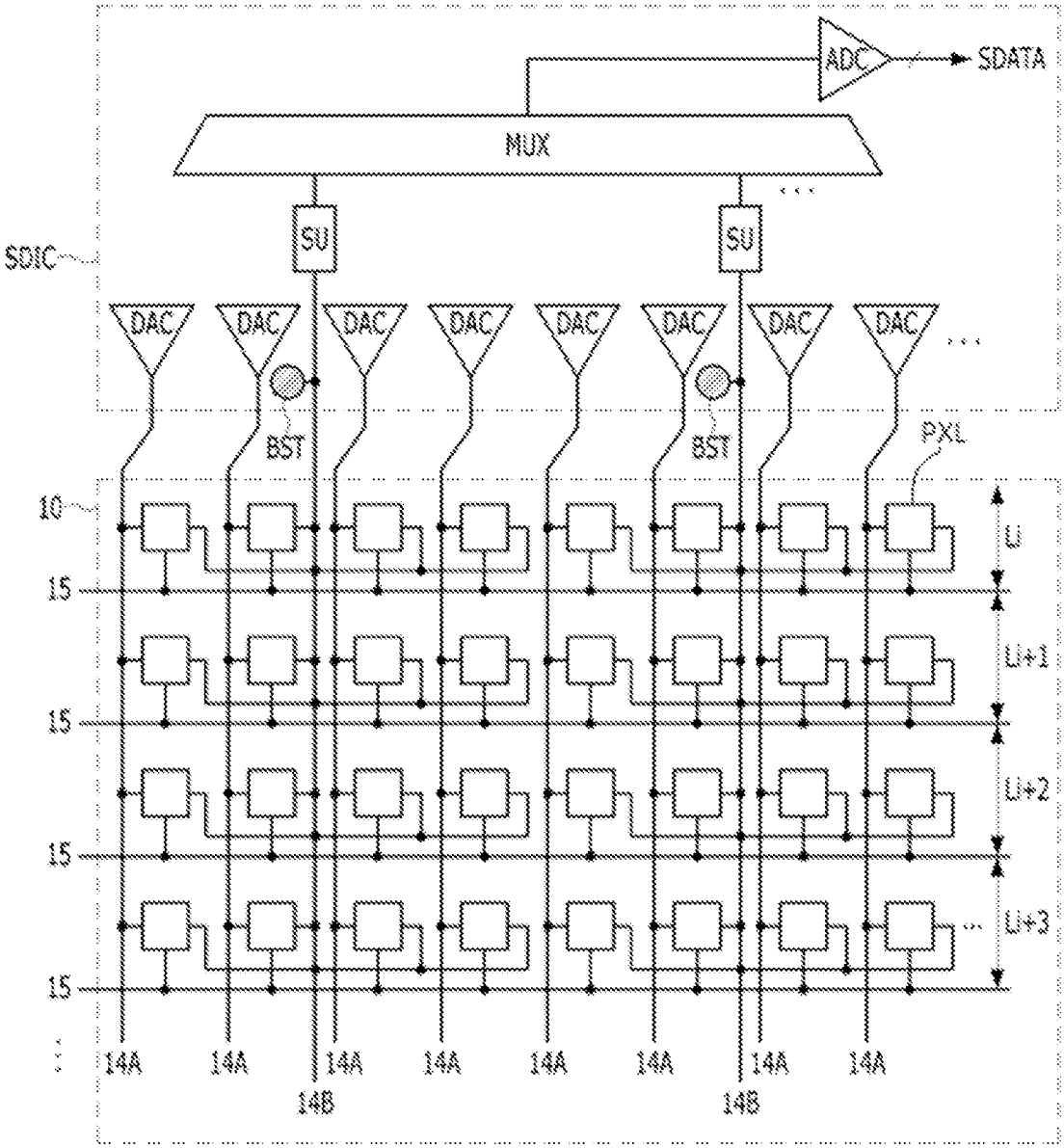
FIG. 3 is a diagram showing an example of a configuration of a pixel array and a source drive IC.

FIG. 1 is a block diagram showing an electroluminescent display device according to an embodiment of the present disclosure, FIG. 2 is a diagram showing an example of connection of one unit pixel sharing a readout line, and FIG. 3 is a diagram showing an example of a configuration of a pixel array and a source drive IC.

Referring to FIG. 1 to FIG. 3, an electroluminescent display device according to an embodiment of the present disclosure includes a display panel 10, a timing controller 11, a data driver 12, a gate driver 13, a memory 16, a compensation circuit 20, and a power generation circuit 30.

A plurality of data lines 14A and a plurality of readout lines 14B are arranged in a manner of intersecting with a plurality of gate lines 15 in the display panel 10 and pixels PXL are arranged in a matrix at intersections to form a pixel array.

Two or more pixels PXL connected to different data lines 14A may share the same readout line 14B and the same gate line 15. For example, a pixel R for expressing red, a pixel W for expressing white, a pixel G for expressing green, and a pixel B for expressing blue which neighbor in the horizontal direction and are connected to the same gate line 15 may be commonly connected to a single readout line 14B, as shown in FIG. 2. According to this readout line sharing structure, a pixel array structure is simplified and thus it is easy to secure an aperture ratio of the display panel and processing margin. In the readout line sharing structure, a plurality of data lines 14A may be arranged between neighboring readout lines 14B.

A pixel R, a pixel W, a pixel G, and a pixel B may constitute a single unit pixel, as shown in FIG. 2. In a unit pixel, red, white, green, and blue may be combined to express various colors according to grayscale rates (or emission rates). A unit pixel may be composed of a pixel R, a pixel G, and a pixel B. In this case, a pixel R, a pixel G, and a pixel B which neighbor in the horizontal direction and are connected to the same gate line 15 may be commonly connected to a single readout line 14B.

Each pixel PXL receives a high-level pixel voltage EVDD and a low-level pixel voltage EVSS from the power generation circuit 30. A pixel PXL in the present disclosure may have a circuit configuration suitable to sense change in electron mobility characteristics of a driving element according to elapsed driving time and/or environmental conditions such as a panel temperature.

The timing controller 11 can execute a sensing mode for sensing operation and a display mode for display operation according to predetermined control sequences. Here, the sensing operation is an operation for sensing change in electron mobility of driving elements and updating a compensation value according thereto, and the display operation is an operation for writing corrected video data CDATA in which a compensation value has been reflected in the display panel 10 to reproduce a display image. The sensing operation may be performed in a vertical blank period during display operation according to control of the timing controller 11. The vertical blank period is provided between vertical active periods in which a data voltage for display is written in pixels PXL. The data voltage for display is not written in the pixels PXL for the vertical blank period. A data voltage for sensing is written in sensing pixels PXL for the vertical blank period.

The sensing operation may be performed in units of pixel lines L1 to Ln. For example, the sensing operation may be sequentially or non-sequentially performed on all pixels of a first color included in the pixel array per pixel line and then sequentially or non-sequentially performed on all pixels of a second color per pixel line. Then, the sensing operation may be performed on pixels of third and fourth colors in the same manner. Here, each of the pixel lines L1 to Ln does not mean a physical signal line but means a set of pixels PXL neighboring in the horizontal direction.

The sensing operation may be performed only on some pixels of different colors included in one pixel line and the sensing operation for the remaining pixels may be omitted. In this case, a compensation value for the remaining pixels may be calculated through an interpolation logic. The interpolation logic may calculate a compensation value for non-sensing pixels of the same color on the basis of compensation values for sensing pixels of the same color. By doing so, a sensing update cycle can be reduced to maximize compensation performance for coping with real-time change in electron mobility.

The timing controller 11 may generate a data timing control signal DDC for controlling operation timing of the data driver 12 and a gate timing control signal GDC for controlling operation timing of the gate driver 13 on the basis of timing signals, such as a vertical synchronization signal Vsync, a horizontal synchronization signal Hsync, a dot clock signal DCLK, and a data enable signal DE, input from a host system. The timing controller 11 may generate timing control signals DDC and GDC for display operation differently from timing control signals DDC and GDC for sensing operation.

The gate timing control signal GDC includes a gate start pulse signal and a gate shift clock signal. The gate start pulse signal is applied to a gate stage generating a first output to control the gate stage. The gate shift clock signal is a clock signal input to gate stages to shift the gate start pulse signal.

The data timing control signal DDC includes a source start pulse signal, a source sampling clock signal, and a source output enable signal. The source start pulse signal controls data sampling start timing of the data driver 12. The source sampling clock signal controls data sampling timing on the basis of a rising or falling edge. The source output enable signal controls output timing of the data driver 12.

The timing controller 11 may include the compensation circuit 20, but the present disclosure is not limited thereto. The compensation circuit 20 may be included in a separate compensation integrated circuit.

The compensation circuit 20 receives sensing result data SDATA with respect to electron mobility of driving elements from a sensing circuit SU during sensing operation. The compensation circuit 20 calculates a compensation value for compensating for luminance deviation due to deterioration (i.e., electron mobility change) of driving elements on the basis of the sensing result data SDATA and stores the compensation value in the memory 16. The compensation value may be updated in the memory 16 whenever sensing operation is performed. The memory may be implemented as a flash memory but the present disclosure is not limited thereto.

The compensation circuit 20 may correct input video data DATA on the basis of a compensation value read from the memory 16 and supply the corrected video data CDATA to the data driver 12 during display operation. Luminance deviation due to electron mobility characteristic differences in driving elements can be compensated according to the corrected video data CDATA.

The data driver 12 includes at least one source driver integrated circuit (SDIC). The source driver IC SDIC may include a digital-to-analog converter (DAC) connected to each data line 14A, a sensing circuit SU connected to each readout line 14B, a multiplexer MUX that temporally divides outputs of a plurality of sensing circuits SU, and an analog-to-digital converter (ADC) connected to the multiplexer MUX to convert an analog output of the sensing circuit SU into sensing result data SDATA.

The DAC converts corrected image data CDATA into a data voltage for display and supplies the data voltage for display to the data lines 14A according to the data timing control signal DDC supplied from the timing controller 11 during display operation. The DAC of the source driver IC SDIC may generate a data voltage for sensing and supply the data voltage for sensing to the data lines 14A according to the data timing control signal DDC supplied from the timing controller 11 during sensing operation.

The data voltage for sensing may include an on-level data voltage (Von in FIG. 4) for turning on driving elements and an off-level data voltage (Voff in FIG. 4) for turning off the driving elements. The on-level data voltage is applied to a sensing pixel among pixels sharing a readout line 14B and the off-level data voltage is applied to a non-sensing pixel among pixels sharing a readout line 14B. The on-level data voltage is a voltage applied to a gate electrode of a driving element included in a sensing pixel to turn on the driving element (i.e., a voltage generating a pixel current) during sensing operation and the off-level data voltage is a voltage applied to a gate electrode of a driving element included in a non-sensing pixel to turn off the driving element (i.e., a voltage blocking a pixel current) during sensing operation. The on-level data voltage may be set to different levels for red, green, blue, and white pixels R, G, B, and W in consideration of different driving characteristics of driving elements/light emitting elements for respective colors, but the present disclosure is not limited thereto.

The on-level data voltage is applied to a sensing pixel in a unit pixel and the off-level data voltage is applied to non-sensing pixels sharing a readout line 14B with the sensing pixel in the unit pixel. For example, if a pixel R is sensed and pixels W, G, and B are not sensed in FIG. 2, the on-level data voltage may be applied to a driving element of the pixel R and the off-level data voltage may be applied to driving elements of the pixels W, G, and B.

Each sensing circuit SU may be connected to each readout line 14B and selectively connected to the ADC through the multiplexer MUX. Each sensing circuit SU is implemented as a voltage sensing type such that it can sense a voltage of the readout line 14B which varies according to a pixel current flowing through the driving element of a sensing pixel during sensing operation. The sensing circuit SU applies a reference voltage VPRER for display received from the power generation circuit 30 to the pixels PXL during display operation and applies a reference voltage VPRES for sensing received from the power generation circuit 30 to the pixels PXL during sensing operation.

The ADC may convert an analog sensing voltage output from each sensing circuit SU into digital sensing result data SDATA and output the digital sensing result data to the compensation circuit 20.

The gate driver 13 may generate a gate signal for sensing on the basis of the gate control signal GDC and then supply the gate signal for sensing to gate lines 15 connected to sensing pixels during sensing operation. The gate signal for sensing is a scan signal for sensing synchronized with a data voltage for sensing. The pixel lines L1 to Ln can be sequentially or non-sequentially driven for sensing according to the gate signal for sensing and the data voltage for sensing.

The gate driver 13 may generate a gate signal for display on the basis of the gate control signal GDC and then sequentially supply the gate signal for display to the gate lines 15 during display operation. The gate signal for display is a scan signal for display synchronized with a data voltage for display. The pixel lines L1 to Ln can be sequentially or non-sequentially driven for display according to the gate signal for display and the data voltage for display.

The power generation circuit 30 generates a high-level pixel voltage EVDD, a low-level pixel voltage EVSS, the reference voltage VPRER for display, and the reference voltage VPRES for sensing to be supplied to each pixel PXL. The power generation circuit 30 may generate a gate on voltage and a gate off voltage necessary for operation of the gate driver 13 and supply the same to the gate driver 13. The gate signal for sensing or display swings between the gate on voltage (i.e., an on level) and the gate off voltage (i.e., an off level). The power generation circuit 30 may generate a high-level driving voltage necessary for operation of the DAC and supply the same to the data driver 12.

The above-described electroluminescent display device according to an embodiment of the present disclosure compensates for change in electron mobility of the driving element included in each pixel through sensing operation. The electroluminescent display device senses a voltage of the readout lines 14B which varies according to a pixel current during sensing operation and detects electron mobility variation in sensing pixels on the basis of a voltage change gradient of the readout lines 14B obtained through calculation.

A pixel current is proportional to electron mobility of a driving element. The electron mobility of the driving element may vary according to driving time, temperature, and the like. When the electron mobility of a first driving element included in a first pixel differs from the electron mobility of a second driving element included in a second pixel, a first pixel current of the first driving element and a second pixel current of the second driving element, which correspond to the same gate-source voltage, are different from each other during sensing operation. This pixel current difference appears as a difference between voltages charged in the corresponding readout line 14B for the same time, and thus a voltage change gradient of the readout line 14B per unit time can be calculated. Since a voltage charging rate of the readout line 14B increases as the electron mobility of the driving element increases, the voltage change gradient of the readout line 14B is proportional to the electron mobility.

To accurately sense change in the electron mobility of the driving element, the gate-source voltage (i.e., a difference between the data voltage for sensing and the reference voltage for sensing) of the driving element needs to be maintained as a specific level during sensing operation. That is, each sensing pixel needs to operate as a constant current source. However, the gate-source voltage of the driving element may be lost due to a parasitic capacitor around the driving element. Such loss causes sensing distortion.

The electroluminescent display device according to an embodiment of the present disclosure includes a boosting circuit BST as shown in FIG. 3 in order to curb the aforementioned loss. Although the boosting circuit BST is connected to only the readout line 14B in FIG. 3, only a part of connections of the boosting circuit BST is schematically illustrated. The boosting circuit BST may be connected between the data line 14A and the readout line 14B. The boosting circuit BST changes a voltage of the data line 14A by voltage variation in the readout line 14B during sensing operation by including a boosting capacitor (Cbst in FIG. 4) to maintain the gate-source voltage of the driving element as a set level. The electroluminescent display device according to the present disclosure can maximize sensing performance and compensation performance related to the electron mobility of the driving element by including the boosting circuit BST.

Figure 4:
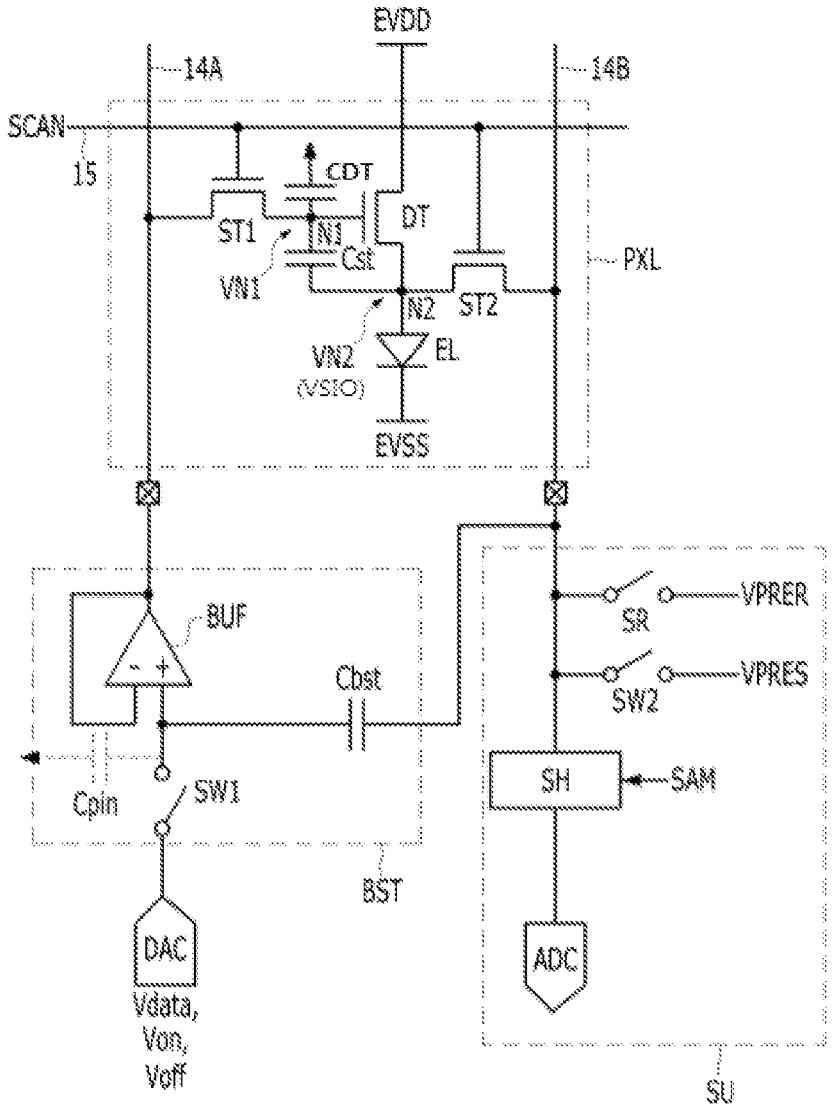
FIG. 4 is a diagram showing an example of a configuration of a pixel circuit, a sensing circuit, and a boosting circuit according to an embodiment of the present disclosure.
Figure 5:
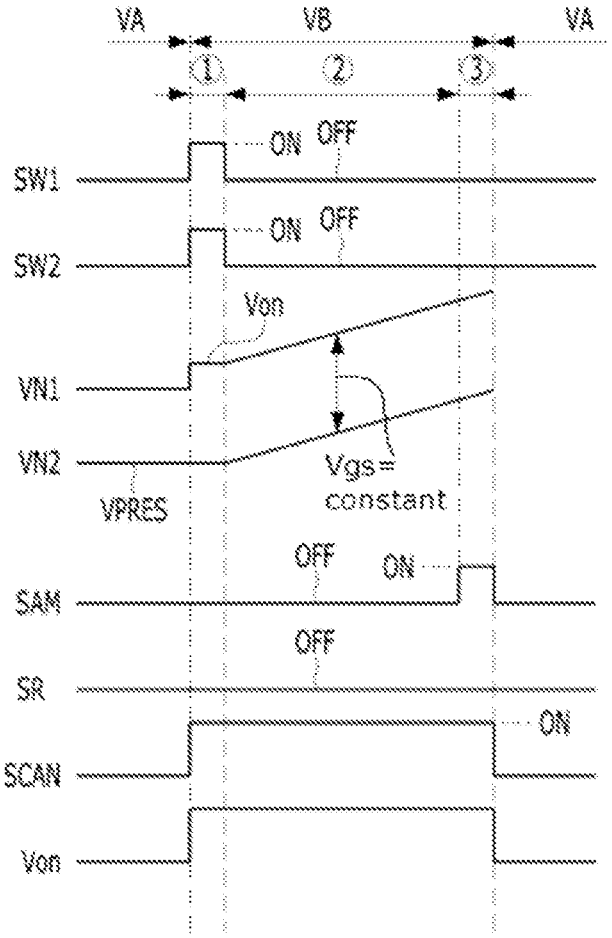
FIG. 5 is a waveform diagram for driving the circuits illustrated in FIG. 4.
Figure 6:
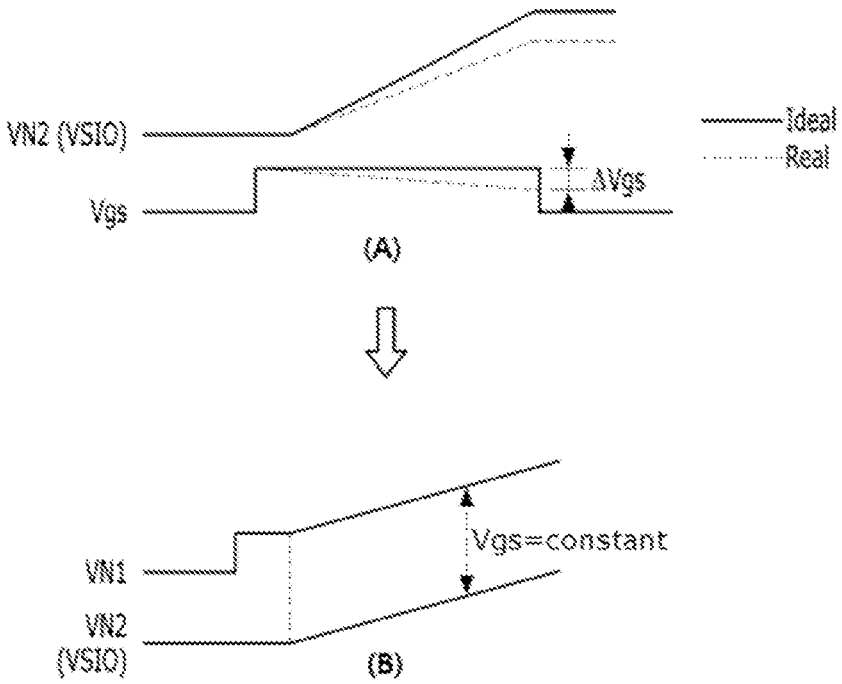
FIG. 6 is a diagram for describing differences in operations and effects according to presence and absence of the boosting circuit.

FIG. 4 is a diagram showing an example of a configuration of a pixel circuit, a sensing circuit, and a boosting circuit according to an embodiment of the present disclosure, FIG. 5 is a waveform diagram for driving the circuits illustrated in FIG. 4, and FIG. 6 is a diagram for describing differences in operations and effects according to presence and absence of the boosting circuit.

Referring to FIG. 4, the electroluminescent display device according to an embodiment of the present disclosure includes a pixel PXL including a driving element DT having a gate electrode connected to the data line 14A and a source electrode connected to the readout line 14B during sensing operation, a sensing circuit SU configured to sense a voltage of the readout line which varies according to a pixel current flowing through the driving element during the sensing operation, and a boosting circuit BST that is connected between the data line 14A and the readout line 14B and changes a voltage of the data line 14A by voltage variation in the readout line 14B during the sensing operation. The electroluminescent display device according to an embodiment of the present disclosure further includes a DAC that outputs a data voltage (Vdata, Von, or Voff).

Referring to FIG. 4, the pixel PXL may further include a light emitting element EL, a storage capacitor Cst, a first switch transistor ST1, and a second switch transistor ST2 in addition to the driving element DT. The driving element DT may be implemented as a driving transistor. Although the driving transistor DT and the switch transistors ST1 and ST2 may be implemented as n-type thin film transistors (TFTs) in the present embodiment, the present disclosure is not limited thereto and they may be implemented as p-type TFTs. Further, semiconductor layers of TFTs constituting the pixel may include amorphous silicon, polysilicon, or an oxide.

The driving transistor DT includes the gate electrode connected to a first node N1, the source electrode connected to a second node N2, and a drain electrode connected to an input terminal for the high-level pixel voltage EVDD. The driving transistor DT generates a pixel current according to a gate-source voltage. The pixel current may be generated as a magnitude proportional to a square of the gate-source voltage. The electron mobility of the driving transistor DT may vary according to deterioration deviation, temperature, or the like in pixels. Accordingly, change in driving characteristics of the driving transistor DT included in a pixel can be detected by sensing a voltage of the readout line 14B according to the pixel current during sensing operation.

The light emitting element EL is turned on when the voltage of the second node N2 reaches an operating point level according to the pixel current to emit light according to the pixel current during display operation. The light emitting element EL includes an anode connected to the second node N2, a cathode connected to an input terminal for the low-level pixel voltage EVSS, and an organic or inorganic compound layer interposed between the anode and the cathode. The organic or inorganic compound layer includes a hole injection layer (HIL), a hole transport layer (HTL), an emission layer (EML), an electron transport layer (ETL), and an electron injection layer (EIL). When the voltage of the second node N2 applied to the anode increases to be higher than the operating point level as compared to the low-level pixel voltage EVSS applied to the cathode, the light emitting element EL is turned on. When the light emitting element EL is turned on, holes that have passed through the hole transport layer (HTL) and electrons that have passed through the electron transport layer (ETL) move to the emission layer (EML) to form excitons, and thus the emission layer (EML) emits light.

Meanwhile, to improve sensitivity of sensing (or accuracy of sensing), sensing operation is performed in a state in which the light emitting element EL is turned off. In other words, sensing operation is performed within a range within which the voltage of the second node N2 is lower than the operating point level of the light emitting element EL. To this end, the reference voltage VPRES for sensing applied to the second node N2 may be set to be sufficiently lower than the operating point level and the reference voltage VPRER for display.

The storage capacitor Cst is connected between the first node N1 and the second node N2. The storage capacitor Cst stores the gate-source voltage of the driving transistor DT, but it is difficult for the storage capacitor Cst to maintain the gate-source voltage without leakage due to a parasitic capacitor.

The first switch transistor ST1 connects the data line 14A to the first node N1 according to a gate signal SCAN. The first switch transistor ST1 includes a gate electrode connected to the gate line 15, a first electrode (one of a source and a drain) connected to the data line 14A, and a second electrode (the other of the source and the drain) connected to the first node N1.

The second switch transistor ST2 connects the second node N2 to the readout line 14B according to the gate signal SCAN. The second switch transistor ST2 includes a gate electrode connected to the gate line 15, a first electrode connected to the readout line 14B, and a second electrode connected to the second node N2.

The gate electrodes of the first and second switch transistors ST1 and ST2 are connected to the same gate line 15, and thus the structures of the pixel and the gate driver are simplified. When the first and second switch transistors ST1 and ST2 are turned on according to a gate signal SCAN for display during display operation, a first gate-source voltage (Vdata-VPRER) of the driving transistor DT is programmed in accordance with display operation conditions. When the first and second switch transistors ST1 and ST2 are turned on according to a gate signal SCAN for sensing during sensing operation, a second gate-source voltage (Von-VPRES) of the driving transistor DT is programmed in accordance with sensing operation conditions. The first and second switch transistors ST1 and ST2 maintain an on state according to the gate signal SCAN for sensing shown in FIG. 5 during sensing operation.

Referring to FIG. 4, the DAC outputs a data voltage Vdata for display during display operation and outputs a data voltage Von or Voff for sensing during sensing operation.

Referring to FIG. 4, the sensing circuit SU includes a switch SR switching on/off for a current flow between an input terminal for the reference voltage VPRER for display and the readout line 14B, a switch SW2 switching on/off for a current flow between an input terminal for the reference voltage VPRES for sensing and the readout line 14B, and a sampling circuit SH operating according to a sampling signal SAM.

The switch SR is turned on in response to the gate signal SCAN for display during display operation. The reference voltage VPRER for display is applied to the second node N2 through the readout line 14B and the second switch ST2.

Sensing operation is performed in a vertical blank period VB as shown in FIG. 5. In FIG. 5, VA represents a vertical active period in which display operation is performed. Sensing operation in vertical blank period VB may be temporally divided into a programming period ①, a sensing period ②, and a sampling period ③. The switch SW2 is turned on in an on period of the gate signal SCAN for sensing in the programming period ①. The reference voltage VPRES for sensing is applied to the second node N2 in sensing period ② through the readout line 14B and the second switch transistor ST2. The switch SW2 is turned off and the sampling signal SAM is on in the on period of the gate signal SCAN for sensing corresponding to the sampling period ③.

The sampling circuit SH samples the voltage of the readout line 14B in response to the sampling signal SAM.

Referring to FIG. 4 and FIG. 5, a pixel current is determined by a difference (Von-VPRES) between the gate-source voltage (i.e., a first node voltage VN1) of the driving transistor DT and a second node voltage VN2 during sensing operation. The boosting circuit BST may transmit the data voltage Von for sensing output from the DAC to the data line 14A in the programming period ①, float the data line 14A and couple the readout line 14B to the floating data line 14A in the sensing period ② and the sampling period ③ to change the voltage of the data line 14A by voltage variation in the readout line 14B. Since the switch transistors ST1 and ST2 maintain an on state for the sensing period ②, the second node voltage VN2 and the voltage of the readout line 14B equally change and the first node voltage VN1 and the voltage of the data line 14A equally change in the sensing period ②. In other words, since the first node voltage VN1 changes by change in the second node voltage VN2 according to the pixel current according to the boosting circuit BST, as shown in section (B) of FIG. 6, the gate-source voltage (Von-VPRES) of the driving transistor DT and the pixel current can be maintained constant.

Section (A) of FIG. 6 illustrates gate-source voltage loss ΔVgs when the boosting circuit BST is not present. The gate-source voltage loss ΔVgs is caused by parasitic capacitance CDT coupled to the gate electrode of the driving transistor DT, as represented by mathematical formula 1 below. In mathematical formula 1, CST is capacitance of the storage capacitor Cst and ΔVSIO is a loss of the second node voltage VN2 due to the parasitic capacitance CDT. The parasitic capacitance CDT cannot be artificially controlled because the parasitic capacitance CDT is determined according to panel design specifications. Although a method of increasing the capacitance CST of the storage capacitor Cst such that the gate-source voltage loss ΔVgs decreases may be considered, increase in the capacitance CST of the storage capacitor Cst causes reduction in the aperture ratio of the display panel and thus it is difficult to adopt this method.

$$\Delta Vgs = \left(1 - \frac{CST}{CST + CDT}\right) * \Delta VSIO \quad \text{[Mathematical formula 1]}$$

The gate-source voltage loss ΔVgs may be minimized by the boosting circuit BST, as illustrated in section (B) of FIG. 6. The gate-source voltage loss ΔVgs when the boosting circuit BST is present may be represented by mathematical formula 2 below. In mathematical formula 2, CBST is the capacitance of a boosting capacitor Cbst and Cpin is an equivalent parasitic capacitance appearing at a (+) input terminal of a voltage buffer BUF as illustrated in FIG. 4.

$$\Delta Vgs = \left(1 - \frac{CBST}{CBST + Cpin}\right) * \Delta VSIO \quad \text{[Mathematical formula 2]}$$

As can be clearly ascertained from mathematical formula 2, the gate-source voltage loss ΔVgs can be minimized as CBST increases. The capacitance CBST of the boosting capacitor Cbst can be artificially controlled. Since the capacitance CBST of the boosting capacitor Cbst is irrelevant to the aperture ratio of the display panel, a control permission range thereof is wider than that of the capacitance CST of the storage capacitor Cst.

Referring back to FIG. 5, the switch SW2 of the sensing circuit SU also maintains an off state for the sensing period ②, and thus the readout line 14B also floats at this time. Accordingly, voltage variation in the readout line 14B can be effectively reflected in the electric potential of the data line 14A by the boosting circuit BST for the sensing period ②.

The boosting circuit BST may include the voltage buffer BUF, the boosting capacitor Cbst, and a switch SW1.

The voltage buffer BUF is connected to the data line 14A. A (−) input terminal and an output terminal of the voltage buffer BUF are connected to each other. One electrode of the boosting capacitor Cbst is connected to the readout line 14B and the other electrode thereof is connected to the (+) input terminal of the voltage buffer BUF. The switch SW1 is connected between the (+) input terminal of the voltage buffer BUF and the DAC. The switch SW1 is turned on only in the programming period ①. The data line 14A floats according to the switch SW1 that maintains an off state in the sensing period ② and the sampling period ③.

Figure 7A:
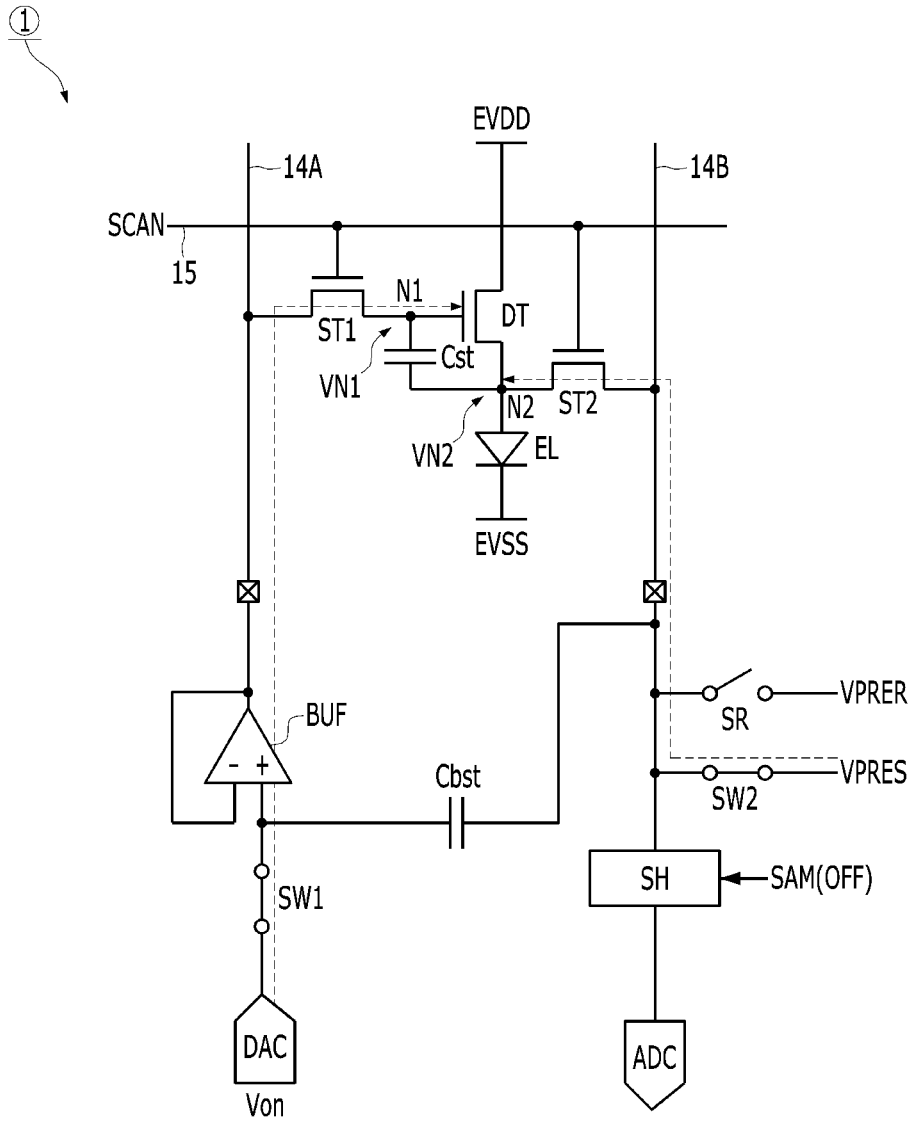
FIG. 7A is an equivalent circuit diagram corresponding to a programming period of FIG. 5.
Figure 7B:
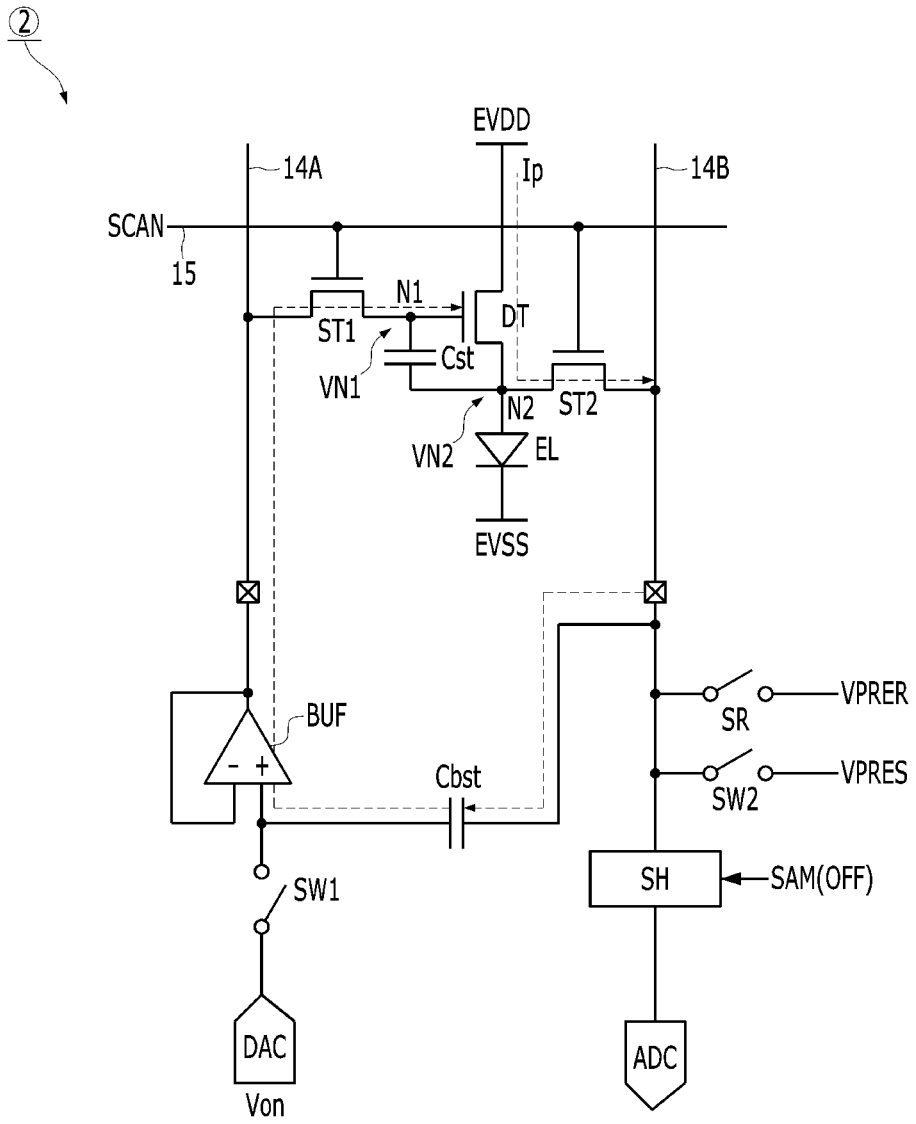
FIG. 7B is an equivalent circuit diagram corresponding to a sensing period of FIG. 5.
Figure 7C:
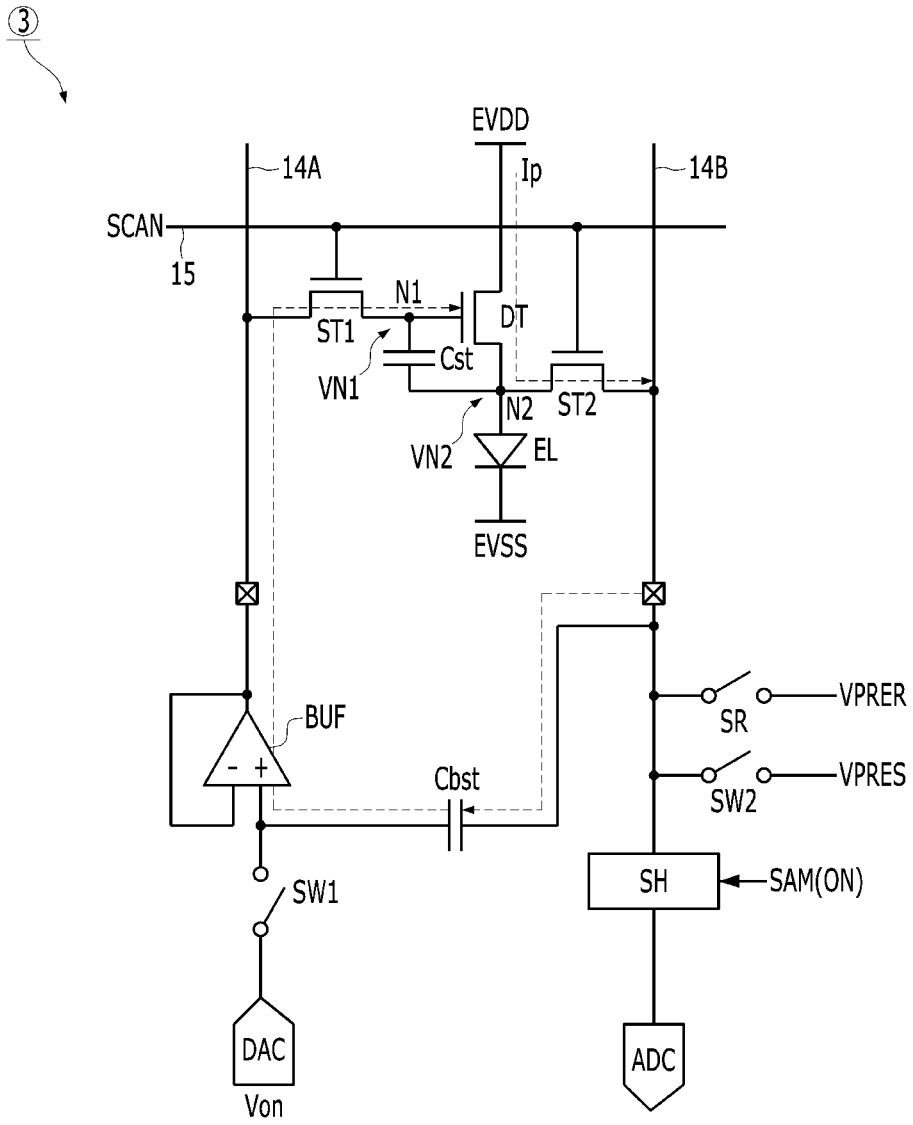
FIG. 7C is an equivalent circuit diagram corresponding to a sampling period of FIG. 5.

FIG. 7A is an equivalent circuit diagram corresponding to the programming period ① of FIG. 5, FIG. 7B is an equivalent circuit diagram corresponding to the sensing period ② of FIG. 5, and FIG. 7C is an equivalent circuit diagram corresponding to the sampling period ③ of FIG. 5.

Sensing operation is performed in order of the programming period ①, the sensing period ②, and the sampling period ③. The first and second switch transistors ST1 and ST2 maintain an on state according to the gate signal SCAN for sensing at an on level during sensing operation.

Referring to FIG. 7A, the switch SW1 and the switch SW2 are turned on in the programming period ①. The on-level data voltage Von for sensing is applied to the first node N1 of the pixel through the switch SW1, the voltage buffer BUF, the data line 14A, and the first switch transistor ST1. In addition, the reference voltage VPRES for sensing is applied to the second node N2 of the pixel through the switch SW2, the readout line 14B, and the second switch transistor ST2. As a result, the gate-source voltage VN1-VN2 of the driving transistor DT for sensing operation is set.

Referring to FIG. 7B, the switch SW1 and the switch SW2 are turned off in the sensing period ② and thus the data line 14A and the readout line 14B float. Here, a pixel current Ip corresponding to the gate-source voltage VN1-VN2 flows through the driving transistor DT. The voltage VN2 of the second node and the voltage of the readout line 14B increase from the reference voltage VPRES for sensing according to the pixel current Ip. Voltage increase of the readout line 14B is reflected in the electric potential of the data line 14A through the boosting capacitor Cbst and the voltage buffer BUF, and the voltage of the data line 14A also increases from the data voltage Von for sensing. The voltage increase gradient of the data line 14A becomes identical to the voltage increase gradient of the readout line 14B according to coupling effect through the boosting capacitor Cbst.

Referring to FIG. 7C, the sampling signal SAM is on in the sampling period ③. The sampling circuit SH samples the voltage of the readout line 14B according to the sampling signal SAM.

Figure 8:
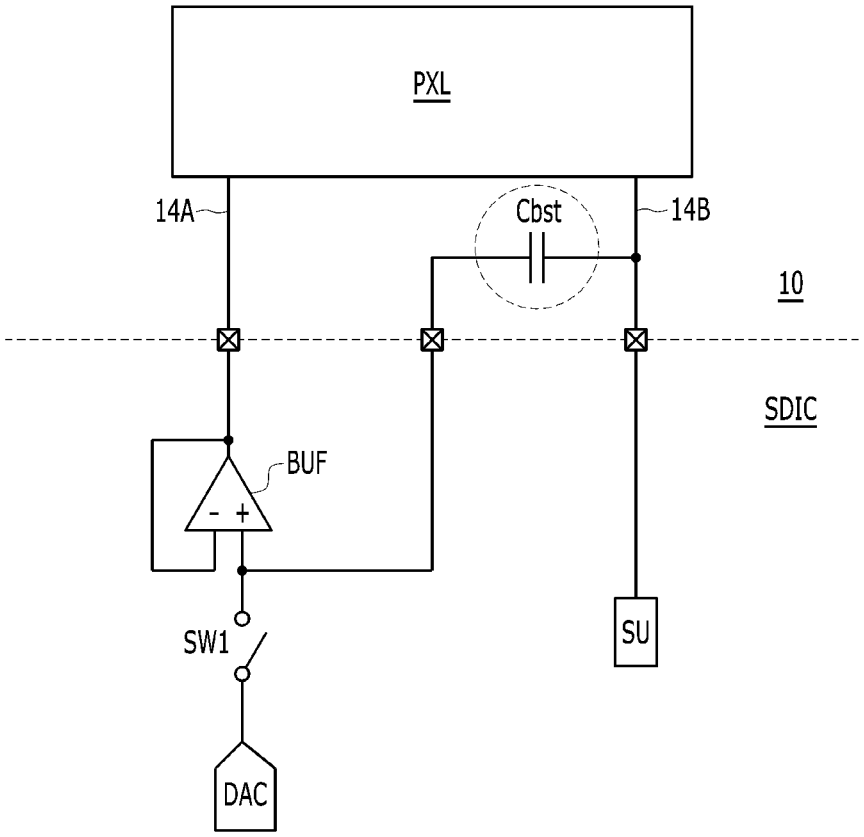
FIG. 8 is a diagram showing an example in which a boosting capacitor included in the boosting circuit is formed in a display panel.
Figure 9:
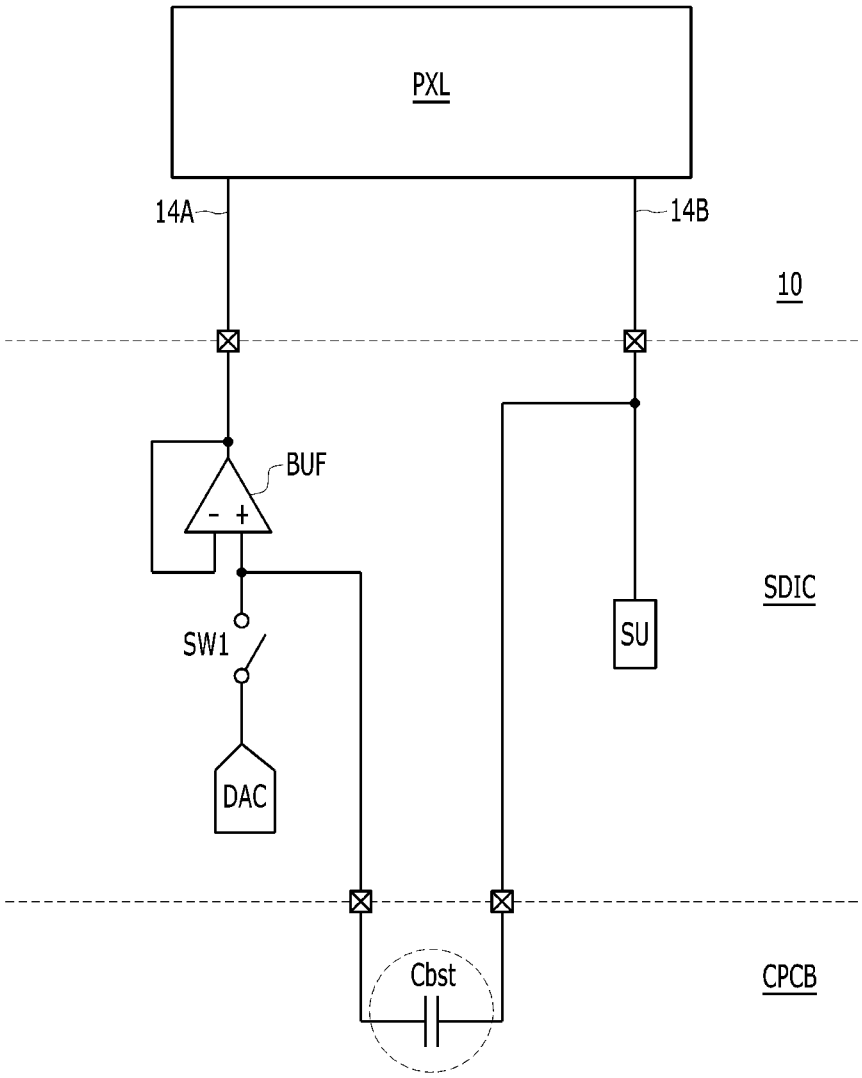
FIG. 9 is a diagram showing an example in which the boosting capacitor included in the boosting circuit is formed on a control printed circuit board.

FIG. 8 is a diagram showing an example in which the boosting capacitor included in the boosting circuit is formed in the display panel and FIG. 9 is a diagram showing an example in which the boosting capacitor included in the boosting circuit is formed on a control printed circuit board.

Referring to FIG. 8, the voltage buffer BUF and the switch SW1 may be positioned in the source driver integrated circuit SDIC and the boosting capacitor Cbst may be positioned in the display panel 10 outside the source driver integrated circuit SDIC. Accordingly, the size of the source driver integrated circuit SDIC can be reduced and the configuration thereof can be simplified. In the display panel 10, the boosting capacitor Cbst may be formed in an area outside the pixels PXL, for example, in a non-display area of the display panel 10. Accordingly, the side effect that the aperture ratio of the pixels PXL is reduced due to the boosting capacitor Cbst can be prevented.

Referring to FIG. 9, the voltage buffer BUF and the switch SW1 may be positioned in the source driver integrated circuit SDIC and the boosting capacitor Cbst may be positioned on a control printed circuit board CPCB outside the source driver integrated circuit SDIC. Accordingly, the size of the source driver integrated circuit SDIC can be reduced and the configuration thereof can be simplified. The timing controller and the like may be mounted on the control printed circuit board CPCB. The control printed circuit board CPCB is electrically connected to the source driver integrated circuit SDIC through a flexible printed circuit film or the like.

Figure 10:
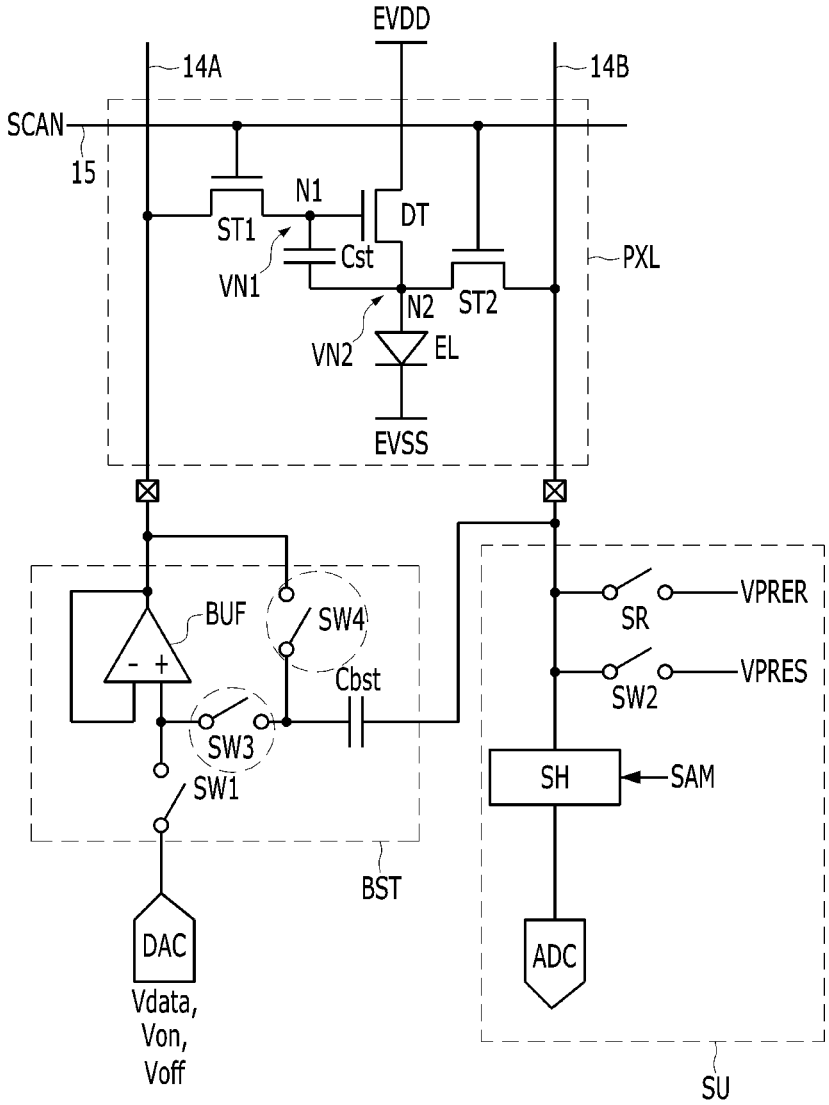
FIG. 10 is a diagram showing an example of a configuration of a pixel circuit, a sensing circuit, and a boosting circuit according to another embodiment of the present disclosure.
Figure 11:
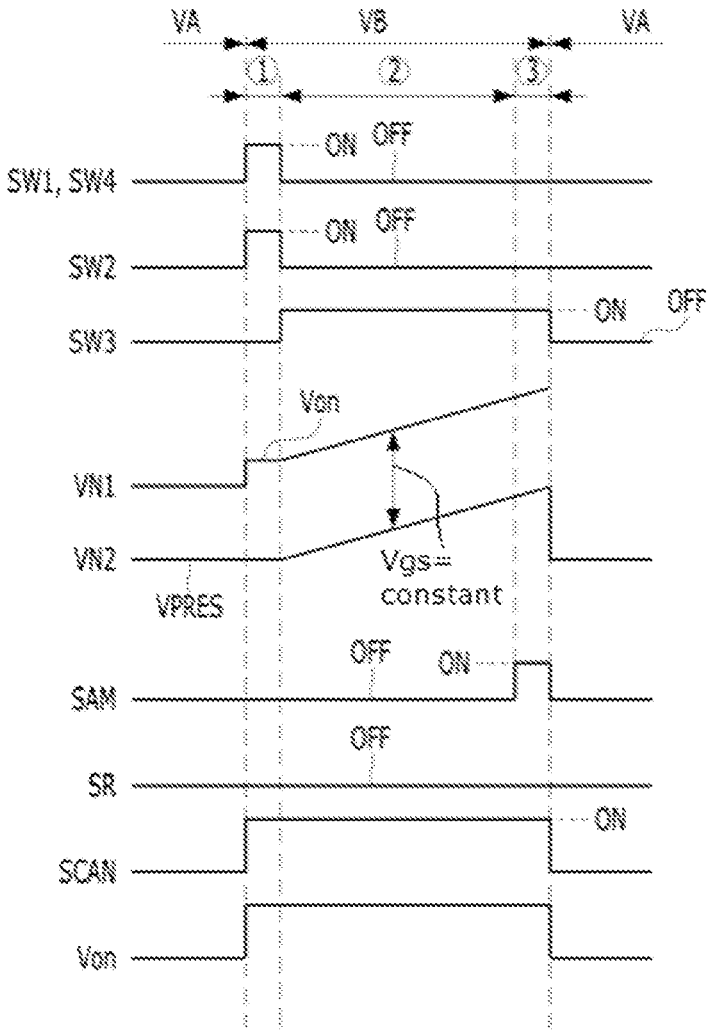
FIG. 11 is a waveform diagram for driving the circuits illustrated in FIG. 10.

FIG. 10 is a diagram showing an example of a configuration of a pixel circuit, a sensing circuit, and a boosting circuit according to another embodiment of the present disclosure and FIG. 11 is a waveform diagram for driving the circuits illustrated in FIG. 10.

In an embodiment of FIG. 10 and FIG. 11, components other than a boosting circuit BST are substantially the same as those in the embodiment of FIG. 4 and FIG. 5. Accordingly, description of the same components will be omitted.

Referring to FIG. 10 and FIG. 11, the boosting circuit BST may further include a switch SW3 and a switch SW4 in addition to the voltage buffer BUF, the boosting capacitor Cbst, and the switch SW1.

The voltage buffer BUF, the boosting capacitor Cbst, and the switch SW1 are substantially same as those described with reference to FIG. 4 and FIG. 5.

The switch SW3 is connected between the other electrode of the boosting capacitor Cbst and the (+) input terminal of the voltage buffer BUF. The switch SW4 is connected between the other electrode of the boosting capacitor Cbst and the data line 14A.

The switch SW3 maintains an off state in the programming period ① and maintains an on state in the sensing period ② and the sampling period ③. In addition, the switch SW4 maintains an on state only in the programming period ① and maintains an off state in the sensing period ② and the sampling period ③.

Since the switch SW3 is turned off in the programming period ①, the data voltage Von for sensing can be charged in the data line 14B more rapidly. In this manner, the embodiment of FIG. 10 and FIG. 11 is effective when charging ability of the DAC is low. In the sensing period ② and the sampling period ③, the other electrode of the boosting capacitor Cbst is connected to the data line 14B through the switch SW3 and the voltage buffer BUF.

Figure 12:
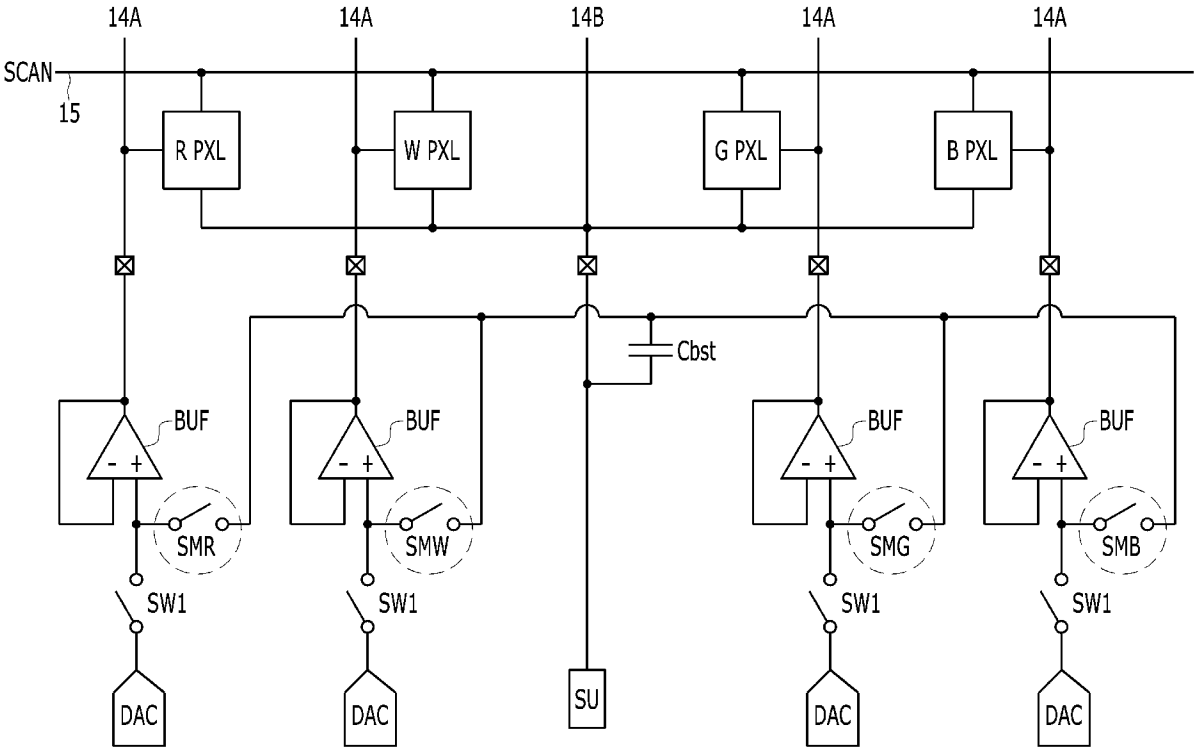
FIG. 12 is a diagram showing that four boosting circuits corresponding to one unit pixel share one single boosting capacitor.

FIG. 12 is a diagram showing that four boosting circuits corresponding to one unit pixel share one single boosting capacitor.

Referring to FIG. 12, four boosting circuits corresponding to pixels R, W, G, and B may share a single boosting capacitor Cbst. In this case, the voltage buffers BUF included in the boosting circuits may be selectively connected to the boosting capacitor Cbst through MUX switches SMR, SMW, SMG, and SMB. A voltage buffer connected to the boosting capacitor Cbst through a MUX switch corresponds to a sensing pixel and other voltage buffers correspond to non-sensing pixels. FIG. 12 shows an example in which a plurality of boosting circuits shares a single boosting capacitor. The technical spirit of the present disclosure may be generalized as follows.

Pixels may include a first pixel connected to a first data line and a readout line and a second pixel connected to a second data line and the readout line. In this case, a boosting circuit may include a first voltage buffer BUF connected to the first data line, a second voltage buffer BUF connected to the second data line, a boosting capacitor Cbst having one electrode connected to the readout line and the other electrode selectively connected to the first voltage buffer and the second voltage buffer, a first MUX switch connected between the other electrode of the boosting capacitor and the first voltage buffer, and a second MUX switch connected between the other electrode of the boosting capacitor and the second voltage buffer.

Figure 13:
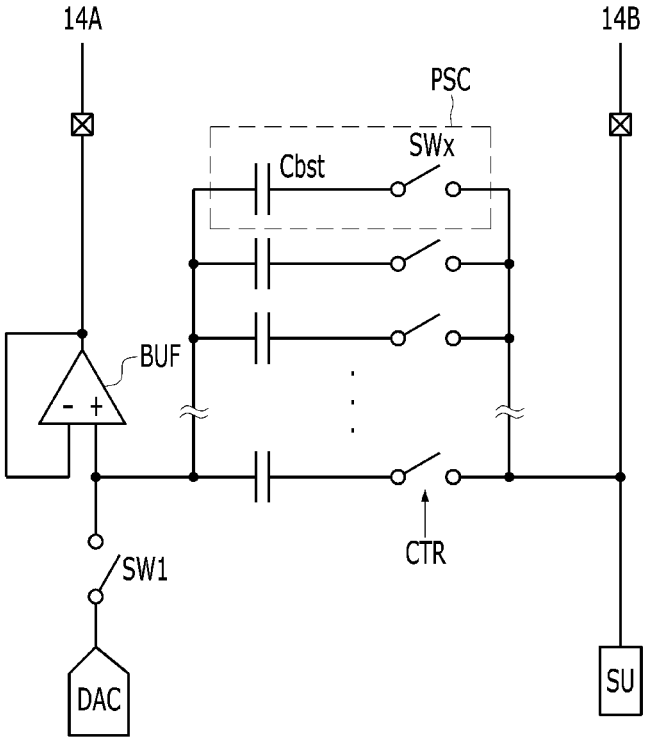
FIG. 13 is a diagram showing a boosting capacitor unit configured to have a total capacitance value that is controllable.

FIG. 13 is a diagram showing a boosting capacitor unit configured to have a total capacitance value that is controllable.

Referring to FIG. 13, a boosting circuit may include a voltage buffer BUF connected to the data line, a boosting capacitor circuit connected between the readout line 14B and the voltage buffer BUF and having a total capacitance value controlled according to a control signal CTR, and a switch SW1 connected between the voltage buffer BUF and a DAC, turned on in a programming period, and turned off in a sensing period and a sampling period.

The boosting capacitor circuit may include a plurality of boosting capacitor units PSC connected between the readout line 14B and the voltage buffer BUF. Each boosting capacitor unit PSC includes a boosting capacitor Cbst and a control switch SWx connected in series. Since the number of control switches to be turned on is determined according to the control signal CTR, CBST can be artificially controlled as described with reference to mathematical formula 2.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The present disclosure has the following advantages.

The electroluminescent display device according to an embodiment of the present disclosure includes the boosting circuit BST for coupling the data line 14A and the readout line 14B during sensing operation. The boosting circuit BST includes the boosting capacitor Cbst and changes the voltage of the data line 14A by voltage variation in the readout line 14B during sensing operation to maintain a gate-source voltage of a driving element as a set level. Accordingly, the present disclosure can maximize sensing performance and compensation performance related to the electron mobility of the driving element.

Effects which may be obtained by the present disclosure are not limited to the above-described effects, and various other effects may be evidently understood by those skilled in the art to which the present disclosure pertains from the following description.

What is claimed is:

1. An electroluminescent display device, comprising:

a pixel including a driving element having a gate electrode connected to a data line and a source electrode connected to a readout line, a first switch transistor having a first electrode connected to the data line and a second electrode connected to the gate electrode of the driving element, a second switch transistor having a first electrode connected to the readout line and a second electrode connected to the source electrode of the driving element, a storage capacitor connected between the gate electrode and the source electrode of the driving element, and a light emitting element connected to the source electrode of the driving element;

a sensing circuit configured to sense a voltage of the readout line which changes according to a pixel current flowing through the driving element during sensing operation; and a boosting circuit distinct from the storage capacitor and connected to the first electrode of the first switch transistor and to the first electrode of the second switch transistor, the boosting circuit having an output connected directly to the data line and an input directly connected to the readout line and configured to change a voltage of the data line according to the voltage in the readout line that is changed during the sensing operation, wherein the boosting circuit includes:

a voltage buffer having a buffer output directly connected to the data line and a first buffer input connected to the buffer output;

a boosting capacitor distinct from the storage capacitor and having a first electrode directly connected to the readout line and a second electrode connected to a second buffer input of the voltage buffer.

2. The electroluminescent display device according to claim 1, wherein, during the sensing operation, a gate-source voltage of the driving element corresponding to the pixel current changes by change in the voltage of the readout line according to the boosting circuit, such that the pixel current and the gate-source voltage of the driving element corresponding to the pixel current are maintained constant.

3. The electroluminescent display device according to claim 1, wherein a gate electrode of the first switch transistor and a gate electrode of the second switch transistor are connected to a gate line, and the first switch transistor and the second switch transistor maintain an on state according to a gate signal for sensing from the gate line during the sensing operation.

4. The electroluminescent display device according to claim 1, further comprising a digital-to-analog converter configured to output a data voltage for sensing to be applied to the gate electrode of the driving element for the pixel current during the sensing operation.

5. The electroluminescent display device according to claim 4, wherein the sensing operation includes a programming period in which a gate-source voltage of the driving element is set for the pixel current, a sensing period in which the voltage of the readout line changes according to the pixel current, and a sampling period in which the voltage of the readout line is sampled, and wherein the boosting circuit transmits the data voltage for sensing to the data line in the programming period, floats the data line and couples the readout line to a floating data line in the sensing period and the sampling period.

6. The electroluminescent display device according to claim 5, wherein the sensing circuit outputs a reference voltage for sensing to be applied to the source electrode of the driving element to the readout line in the programming period and samples the voltage of the readout line according to a sampling signal in the sampling period.

7. The electroluminescent display device according to claim 5, wherein the boosting circuit further includes:

a first switch connected between the second buffer input of the voltage buffer and the digital-to-analog converter, and wherein the first switch is turned on in the programming period, and turned off in the sensing period and the sampling period.

8. The electroluminescent display device according to claim 7, wherein the voltage buffer and the first switch are positioned in a source driver integrated circuit, the boosting capacitor is positioned in a display panel outside the source driver integrated circuit, and the pixel and the boosting capacitor are positioned in different areas in the display panel.

9. The electroluminescent display device according to claim 7, wherein the voltage buffer and the first switch are positioned in a source driver integrated circuit SDIC, and the boosting capacitor is positioned on a control printed circuit board outside the source driver integrated circuit.

10. The electroluminescent display device according to claim 7, wherein the boosting circuit further includes:

a second switch connected between the second electrode of the boosting capacitor and the second buffer input of the voltage buffer; and a third switch connected between the second electrode of the boosting capacitor and the data line.

11. An electroluminescent display device, comprising:

a pixel including a driving element having a gate electrode connected to a data line and a source electrode connected to a readout line, a first switch transistor having a first electrode connected to the data line and a second electrode connected to the gate electrode of the driving element, a second switch transistor having a first electrode connected to the readout line and a second electrode connected to the source electrode of the driving element, a storage capacitor connected between the gate electrode and the source electrode of the driving element, and a light emitting element connected to the source electrode of the driving element;

a sensing circuit configured to sense a voltage of the readout line which changes according to a pixel current flowing through the driving element during sensing operation; and a boosting circuit distinct from the storage capacitor and connected to the first electrode of the first switch transistor and to the first electrode of the second switch transistor, the boosting circuit having an output connected directly to the data line and an input directly connected to the readout line and configured to change a voltage of the data line according to the voltage in the readout line that is changed during the sensing operation, wherein the pixel includes a first pixel connected to a first data line and the readout line and a second pixel connected to a second data line and the readout line, and wherein the boosting circuit includes:

a first voltage buffer connected to the first data line;

a second voltage buffer connected to the second data line;

a boosting capacitor having a first electrode directly connected to the readout line and a second electrode selectively connected to the first voltage buffer and the second voltage buffer;

a first multiplexer switch connected between the second electrode of the boosting capacitor and the first voltage buffer; and a second multiplexer switch connected between the second electrode of the boosting capacitor and the second voltage buffer.

12. An electroluminescent display device, comprising:

a pixel including a driving element having a gate electrode connected to a data line and a source electrode connected to a readout line, a first switch transistor having a first electrode connected to the data line and a second electrode connected to the gate electrode of the driving element, a second switch transistor having a first electrode connected to the readout line and a second electrode connected to the source electrode of the driving element, a storage capacitor connected between the gate electrode and the source electrode of the driving element, and a light emitting element connected to the source electrode of the driving element;

a sensing circuit configured to sense a voltage of the readout line which changes according to a pixel current flowing through the driving element during sensing operation; and a boosting circuit distinct from the storage capacitor and connected to the first electrode of the first switch transistor and to the first electrode of the second switch transistor, the boosting circuit having an output connected directly to the data line and an input directly connected to the readout line and configured to change a voltage of the data line according to the voltage in the readout line that is changed during the sensing operation, wherein the sensing operation includes a programming period in which a gate-source voltage of the driving element is set for the pixel current, a sensing period in which the voltage of the readout line changes according to the pixel current, and a sampling period in which the voltage of the readout line is sampled, and wherein the boosting circuit includes:

a voltage buffer connected to the data line;

a boosting capacitor circuit connected between the readout line and the voltage buffer and having a total capacitance value controlled according to a control signal; and a first switch connected between the voltage buffer and the digital-to-analog converter, the first switch turned on in the programming period, and turned off in the sensing period and the sampling period.

13. The electroluminescent display device according to claim 12, wherein the boosting capacitor circuit includes a plurality of boosting capacitor circuits connected between the readout line and the voltage buffer, wherein each of the boosting capacitor circuits includes a boosting capacitor and a control switch connected in series with the boosting capacitor, and a number of control switches to be turned on is determined according to the control signal.

14. An electroluminescent display device, comprising:

a pixel including a driving element having a gate electrode connected to a data line and a source electrode connected to a readout line, a first switch transistor having a first electrode connected to the data line and a second electrode connected to the gate electrode of the driving element, a second switch transistor having a first electrode connected to the readout line and a second electrode connected to the source electrode of the driving element, a storage capacitor connected between the gate electrode and the source electrode of the driving element, and a light emitting element connected to the source electrode of the driving element;

a sensing circuit configured to sense a voltage of the readout line which changes according to a pixel current flowing through the driving element during sensing operation;

a voltage buffer having an output directly connected to the data line; and a boosting capacitor distinct from the storage capacitor and connected to the first electrode of the second switch transistor and coupled to an input of the voltage buffer and directly to the readout line, the boosting capacitor configured to couple the voltage of the readout line that is changed to the data line through the voltage buffer during the sensing operation.

15. The electroluminescent display device according to claim 14, wherein a gate electrode of the first switch transistor and a gate electrode of the second switch transistor are connected to a gate line, and the first switch transistor and the second switch transistor maintain an on state according to a gate signal for sensing from the gate line during the sensing operation.

16. The electroluminescent display device according to claim 14, wherein the sensing operation includes a programming period in which a gate-source voltage of the driving element is set for the pixel current, a sensing period in which the voltage of the readout line changes according to the pixel current, and a sampling period in which the changed voltage of the readout line is sampled, and wherein a data voltage for sensing is applied to the gate electrode of the driving element in the programming period, and the data line is floated and coupled to the readout line through the boosting capacitor in the sensing period and the sampling period.

17. The electroluminescent display device according to claim 16, wherein a reference voltage for sensing is applied to the source electrode of the driving element via the readout line and the boosting capacitor in the programming period.

18. The electroluminescent display device according to claim 14, wherein the boosting capacitor is positioned in a display panel outside a source driver integrated circuit, and the pixel and the boosting capacitor are positioned in different areas of the display panel.

19. The electroluminescent display device according to claim 14, wherein the boosting capacitor is positioned on a control printed circuit board outside a source driver integrated circuit.

20. The electroluminescent display device according to claim 14, wherein the pixel includes a first pixel connected to a first data line and the readout line and a second pixel connected to a second data line and the readout line, and the boosting capacitor is connected between the readout line and selectively a first voltage buffer or a second voltage buffer.

* * * * *